US005253499A

United States Patent [19]

Knipp et al.

[11] Patent Number: 5,253,499

[45] Date of Patent: Oct. 19, 1993

[54] METHOD FOR STRAIGHTENING COUPLING SHAFTS

[75] Inventors: Kenneth H. Knipp, Ortonville, Mich.; Margot L. Hoffmann, Pemberville, Ohio

[73] Assignee: Dana Corporation, Toledo, Ohio

[21] Appl. No.: 896,828

[22] Filed: Jun. 11, 1992

[51] Int. Cl.[5] ..... B21D 7/06

[52] U.S. Cl. ..... 72/34; 72/389; 29/33 T

[58] Field of Search ..... 72/390, 389, 34, 386, 72/369; 29/335, , 234, 282; 384/537, 536, 519

[56] References Cited

U.S. PATENT DOCUMENTS

| | | | |
|---|---|---|---|
| 2,114,670 | 4/1938 | Searles | 384/536 |
| 2,893,790 | 7/1959 | Raes et al. | 384/536 |
| 2,897,023 | 7/1959 | Burkhalter et al. | 384/536 |
| 3,758,098 | 9/1973 | Vrilakas | 269/55 |
| 4,571,807 | 2/1986 | Hines et al. | 29/252 |
| 4,594,757 | 6/1986 | Johnson, Jr. | 29/33 K |
| 4,674,163 | 6/1987 | Nugier | 29/33 T |
| 4,700,439 | 10/1987 | Hines | 29/33 T |

*Primary Examiner*—Lowell A. Larson
*Assistant Examiner*—Michael J. McKeon
*Attorney, Agent, or Firm*—Marshall & Melhorn

[57] ABSTRACT

A method and apparatus are provided for straightening a coupling shaft comprising a tubular member having a midship tube shaft affixed at one end thereof, with the midship tube shaft mounted in a center shaft support bearing assembly. The coupling shaft is rotatably supported at the end opposite the midship tube shaft and at the center shaft support bearing which rotatably supports the midship tube shaft of the coupling shaft. The coupling shaft is rotated relative to an indicator for measuring radial misalignment thereof, and the radial misalignment is measured at one or more locations along the midship tube shaft. A force is applied to the coupling shaft to permanently deflect the same and thereby reduce any observed radial misalignment.

4 Claims, 2 Drawing Sheets

METHOD FOR STRAIGHTENING COUPLING SHAFTS

BACKGROUND OF THE INVENTION

1. Field of the Invention

The invention relates to a method and apparatus for straightening a coupling shaft, particularly the coupling shaft of a three joint assembly vehicle drive shaft including a center shaft support bearing.

2. Summary of Related Art

Vehicle drive shaft assemblies are comprised of one or more tubular members having elements such as a yoke of a universal joint, a bearing stub or one component of a slip joint fitted at each end thereof. Such elements are usually pressed into the hollow interior of the tubular member(s) and secured by a circumferential weld joint effected between the end of the tubular member and a surface of the inserted element. The drive shaft assembly is utilized as a torque transmitting component of the power train and is most commonly located under the vehicle between the transmission or other gear box and a drive axle.

In some applications, where the length and speed of operation required of the drive shaft would cause excessive radial misalignment (commonly termed "run-out") of a single tubular member, three joint drive shaft assemblies have been utilized. Such drive shaft assemblies include two interconnected tubular members—a coupling shaft connected to the transmission, and a drive shaft connected to the drive axle. The coupling shaft has a yoke for a universal joint mounted at the end connected to the transmission, and a midship tube shaft mounted in the other end. The midship tube shaft is supported by a center shaft support bearing assembly attached to the vehicle frame and is connected, often by means of a slip yoke assembly, to the drive shaft.

In operation, it is important that the tubular members of the drive shaft assembly remain relatively straight and in balance. A lack of straightness or radial alignment may cause noise, vibration and harshness problems in the vehicle. If excessive, radial misalignment may result in failure of the tubular members of the drive shaft assembly.

To avoid such problems, the typical drive shaft fabrication process includes the straightening and subsequent balancing of the tubular members. The straightening step is accomplished by placing the shaft in a straightening device having a hydraulic press which presses against the shaft to achieve radial alignment. The balancing operation requires a balancing machine having an intricate set-up of spindles, shafts and bearings to provide smooth high-speed rotation of the shaft so that vibration sensors may detect out of balance areas on the shaft.

The coupling shafts of three joint drive shaft assemblies have heretofore been straightened prior to mounting on the center shaft support bearing assembly as follows. The tube yoke with journal cross or flange and the midship tube shaft are affixed in the opposing ends of the tubular member of the coupling shaft prior to the straightening operation. The coupling shaft is rotatably mounted in a straightening press off of the open joint or flange in one end, and off of the end of the center of the midship tube shaft at the other end. The coupling shaft is rotated and run-out readings are taken at the bearing surface of the midship tube shaft, near the end of the tubular member. The coupling shaft is then positioned so that the hydraulic press applies a force against the shaft to permanently deflect the same to achieve radial alignment. This process is typically repeated at various points along the tubular member of the coupling shaft. After the straightening operation, the coupling shaft is balanced, either before or after being assembled to the drive shaft. The more effective the straightening operation, the easier and faster the coupling shaft or entire drive shaft assembly is to balance.

The above method is adequate for straightening a drive shaft which is mounted at each end by a universal joint yoke or flange. It is disadvantageous for straightening coupling shafts, however, in that the coupling shaft is straightened with reference to a hypothetical center line created by supporting the coupling shaft at its two ends. The actual center line established after the coupling shaft has been mounted on the vehicle may in fact be quite different from the hypothetical center line used during such a straightening operation. This is because the coupling shaft is actually mounted to the vehicle off of the universal joint yoke at one end, and off of the bearing surface of the midship tube shaft which is supported in the center shaft support bearing. Additionally, run-out readings have heretofore been taken at the bearing surface of the midship tube shaft, which is adjacent the end of the tubular member. However, the run-out may be much greater at the end of the midship tube shaft than that which is measured at the bearing surface. Since the coupling shaft mates with the drive shaft at the end of the midship tube shaft, it is the run-out experienced at that point which has the greatest effect on the alignment of the overall drive shaft assembly.

SUMMARY OF THE INVENTION

The present invention relates to a method of straightening a coupling shaft including a tubular member having a midship tube shaft affixed at one end thereof, with the midship tube shaft mounted in a center shaft support bearing assembly. In accordance with the invention, the coupling shaft is rotatably supported at the end opposite the midship tube shaft and at the center shaft support bearing which rotatably supports the midship tube shaft of the coupling shaft. The coupling shaft is rotated relative to a means for measuring radial misalignment thereof, and the radial misalignment is measured at one or more locations along the midship tube shaft. A force is applied to the coupling shaft to permanently deflect the same and thereby reduce any observed radial misalignment.

The invention also relates to an apparatus for straightening a coupling shaft including a tubular member having a midship tube shaft affixed at one end of the tubular member, with the midship tube shaft mounted in a center shaft support bearing assembly. The apparatus comprises a frame having a headstock mounted thereon for rotatably supporting the coupling shaft at the end opposite the midship tube shaft. Also mounted on the frame is a straightening head for supporting the coupling shaft at the center shaft support bearing. Extending from the frame is a means for measuring radial misalignment of the coupling shaft. A press is also mounted to the frame for applying a force to the coupling shaft to permanently deflect the same, thereby reducing any observed radial misalignment.

This novel method and apparatus are advantageous in that the coupling shaft is straightened with reference to a center line which more closely approximates the center line which will be established once the coupling shaft is mounted to a vehicle. The coupling shaft is therefore provided with greater initial straightness and balance than heretofore possible. Additionally, by supporting the coupling shaft at the center shaft support bearing and measuring run-out at the end of the midship tube shaft, a more accurate indication of the magnitude of the radial misalignment of the coupling shaft is provided.

BRIEF DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENTS

Figure 1:
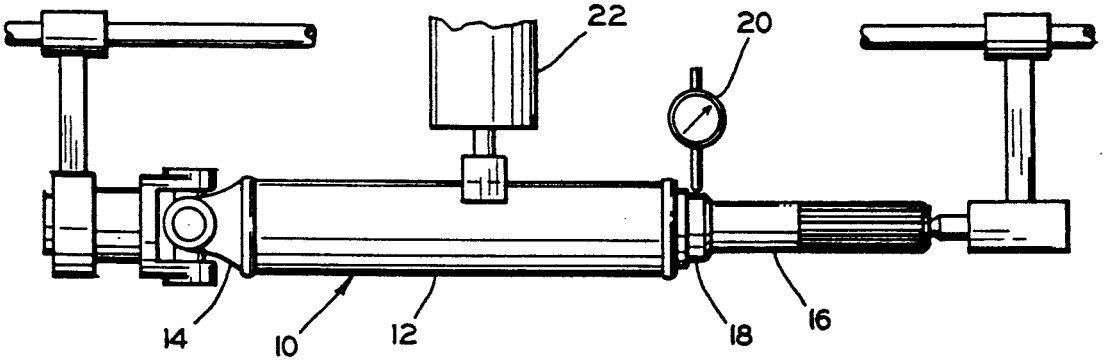
PRIOR ART FIG. 1
FIG. 1 is a schematic diagram of the prior art straightening apparatus.

Referring now to the drawings, there is illustrated in FIG. 1 a schematic drawing of the prior art straightening method and apparatus having the coupling shaft 10 of a three joint drive shaft assembly mounted thereon. The coupling shaft 10 includes a tubular member 12 having a yoke 14 for a universal joint mounted at one end, and a midship tube shaft 16 mounted in the other end. The midship tube shaft 16 is provided with a bearing surface 18 proximate the end of the tubular member 12. The other end of the midship tube shaft is provided with external splines for mating with a drive shaft via a slip yoke assembly (not shown).

In the prior art method of straightening the coupling shaft 10, the coupling shaft 10 is rotatably mounted in a straightening press off of the open joint or flange in one end, and off of the center of the midship tube shaft 16 at the other end as shown in FIG. 1. The coupling shaft 10 is rotated about its longitudinal axis and run-out readings are taken at the bearing surface 18 of the midship tube shaft 16, near the end of the tubular member 12, using an indicator 20. The coupling shaft 10 is then positioned so that the hydraulic press 22 applies a force laterally against the shaft to permanently deflect the same to thereby achieve radial alignment. Generally, straightening cradles are located under the tubular member 12 and the midship tube shaft 16 to limit the amount of force exerted on the shaft. This process is typically repeated, taking run-out readings at various points along the tubular member 12 of the coupling shaft 10.

Figure 2:
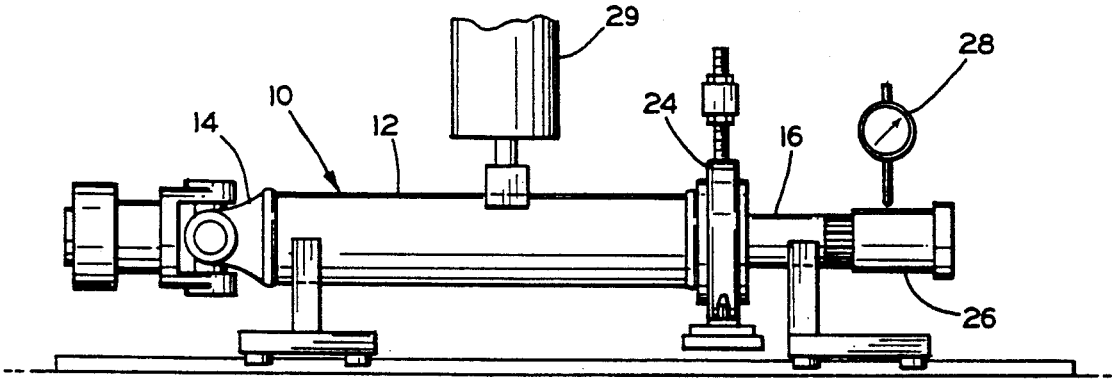
FIG. 2 is a schematic diagram of a straightening apparatus in accordance with the present invention.

The method and apparatus for straightening a coupling shaft in accordance with the present invention are illustrated schematically in FIG. 2. The coupling shaft 10 shown in FIGS. 1 is identical with that shown in FIG. 2, and like reference numerals for the elements thereof are used in both. Thus, the coupling shaft 10 is fixtured into the straightening apparatus by rotatably supporting the open joint or flange attached to the tube yoke 14 affixed in one end of the tubular member 12. The apparatus also supports the coupling shaft 10 at a center shaft support bearing assembly 24, which rotatably supports the midship tube shaft of the coupling shaft. A sleeve 26 is positioned over the end of the midship tube shaft 16 to provide a smooth cylindrical reference surface. The sleeve 26 includes means for preventing relative rotation between the sleeve and the end of the midship tube shaft 16, such as internal splines or the like. The coupling shaft 10 is rotated about its longitudinal axis relative to an indicator 28 to measure radial misalignment at one or more locations along the sleeve 26 on the midship tube shaft 16. A force is applied to the coupling shaft 10 as by a hydraulic press 29 to permanently deflect the same and thereby eliminate any observed radial misalignment.

Figure 3:
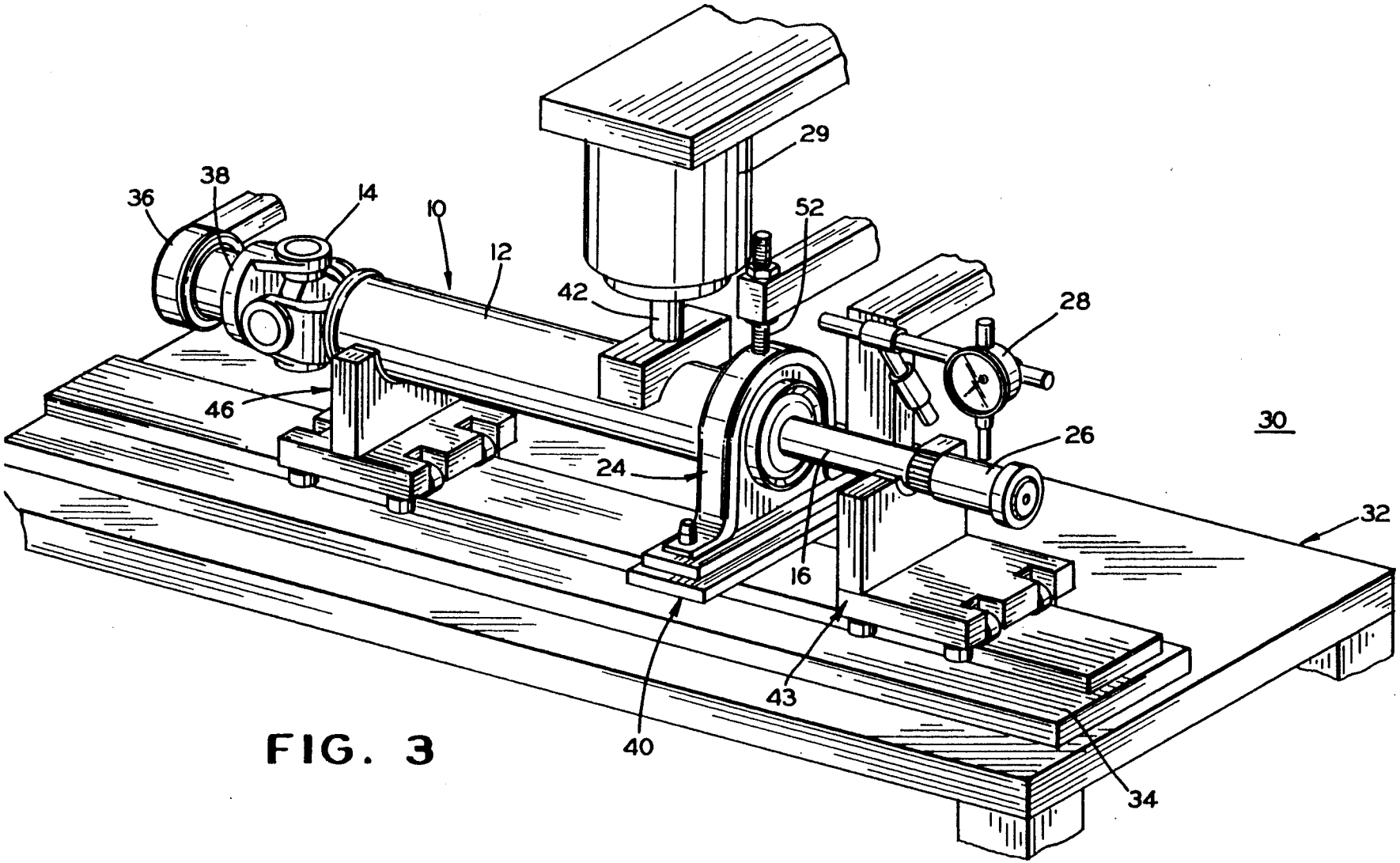
FIG. 3 is perspective view of the straightening apparatus in accordance with the present invention.

FIG. 3 illustrates in more detail the straightening apparatus in accordance with the present invention. As noted above, the coupling shaft 10 is fully assembled prior to the straightening operation. That is, the tube yoke 14 is inserted in one end of tubular member 12 and is secured therein by a circumferential weld joint effected between the end of the tubular member 12 and a surface of the inserted yoke 14. Similarly, the midship tube shaft 16 is inserted in the opposite end of tubular member 12 and is secured therein by a circumferential weld joint effected between the end of the tubular member 12 and a surface of the midship tube shaft 16. The center shaft support bearing assembly 24 is pressed on to the bearing surface 18 of the midship tube shaft 16.

The straightening apparatus, denoted generally by reference numeral 30, is comprised of a frame 32 including a horizontally disposed plate or table 34 mounted thereon. The vertically disposed hydraulic press 29 is attached to the frame 32 and is positioned so that the longitudinal axis of the press 29 intersects the longitudinal axis of the coupling shaft 10 as mounted in the straightening apparatus 30. The press 29 preferably includes a ram member 42 having a face curved to substantially conform to the outer surface of the coupling shaft.

A headstock 36 having a fixture 38 rotatably supported thereon is mounted proximate one end of the table 34. The fixture 38 is adapted to support the ends and outer diameter of the bearing races of the journal cross mounted on the yoke 14, thereby rotatably supporting one end of the coupling shaft 10. Proximate the opposite end of the table 34 there is mounted a center bearing straightening head 40 for supporting the center shaft support bearing assembly 24 as will be described in more detail below. Both the headstock 36 and straightening head 40 are mounted to a rail (not shown) so as to be slidable in the direction of the longitudinal axis of the coupling shaft 10 as mounted in the straightening apparatus 30. The coupling shaft 10, mounted to the headstock 36 and straightening head 40, may thus be moved along with the headstock 36 and straightening head 40 longitudinally relative to the table 34 and the press 29. The headstock 36 and the straightening head 40 may be moved independently to accommodate coupling shafts of various lengths.

Straightening cradles 43 and 46 are provided to support the midship tube shaft 16 and tubular member 12, respectively, when the press 29 is activated to apply a force to the coupling shaft 10. The cradle 43 thus serves to minimize the force applied to the center shaft support bearing assembly 24. The cradles 43 and 45 are mounted to the table 34 so as to be slidable in the direction of the longitudinal axis of the coupling shaft 10, and preferably include an upper face which is curved to conform substantially to the configuration of the midship tube shaft 16 and tubular member 12, respectively. The cradles 43 and 45 are positioned directly beneath the coupling shaft 10, there being a slight gap therebetween so that the coupling shaft does not contact the cradles unless and until the press 29 is activated, so as to not interfere with the rotation of the coupling shaft 10 and taking of run-out readings.

An indicator, such as dial indicator 28, for measuring the magnitude of radial misalignment of the coupling shaft 10 is mounted to the frame 32. Preferably, the indicator 28 is mounted to the straightening head 40 so as to move therewith. The indicator 28 may be adjustably mounted to the straightening head 40 to allow the taking of run-out readings at the sleeve 26 on midship tube shafts 16 of various lengths.

Figure 4:
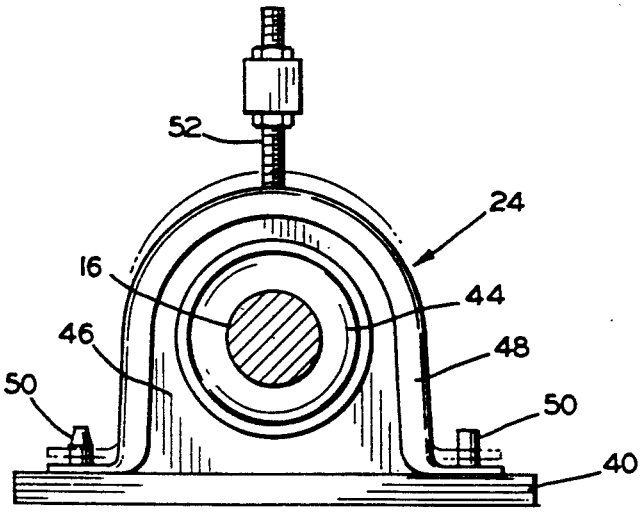
FIG. 4 is an enlarged end view of the center shaft support bearing assembly as mounted to the straightening apparatus of FIG. 3.

As best seen in FIG. 4, the center shaft support bearing assembly 24 includes an annular bearing 44 mounted within an elastic bearing retainer 46 formed of rubber or the like, and a generally U-shaped bracket 48 encompassing the bearing retainer 46. The midship tube shaft 16 of the coupling shaft 10 is rotatably mounted in the bearing 44. The center shaft support bearing assembly 24 is positioned and retained on the straightening head 40 by means of a pair of support pins 50 extending upwardly from the straightening head 40 and projecting through openings formed in each end of the bracket 48. A cylinder actuated or lever actuated vertically reciprocatable plunger 52 selectively engages the bracket 48 near its center to urge the bracket 48 towards the straightening head 40 until the ends of the bracket 48 abut the straightening head 40, simultaneously compressing the bearing retainer 46. The coupling shaft 10 is thereby mounted to the straightening apparatus in much the way it will subsequently be mounted in a vehicle.

To straighten a coupling shaft 10, the open joint or flange attached to the tube yoke 14 is rotatably supported by the headstock 36 of the straightening apparatus 30 in the conventional manner. The center shaft support bearing assembly 24 is supported on the straightening head 40, with the hole in each end of the bracket 48 positioned over the associated pin 50 extending from the straightening head 40. Preferably, the straightening head 40 may be provided with various interchangeable sets of pins 50 having different spacing and positioned at different heights to accommodate brackets of various sizes. The plunger 52 is activated to engage the bracket 48 near its center, urging the bracket 48 towards the straightening head 40 until the ends of the bracket 48 abut the straightening head 40, going from the broken line position to the solid line position as shown in FIG. 4. As the center shaft support bearing assembly 24 rotatably supports the midship tube shaft 16, the coupling shaft 10 is now rotatably mounted on the straightening apparatus 30.

The internally splined sleeve 26 is positioned over the end of the midship tube shaft 16 to provide a smooth cylindrical reference surface which facilitates the taking of run-out readings. The dial indicator 28 is positioned so as to engage the surface of the sleeve 26 and the coupling shaft 10 is rotated about its longitudinal axis to measure the magnitude of any radial misalignment. The coupling shaft 10 may be rotated manually or, alternatively, the straightening apparatus 30 may include drive means (not shown) connected to the headstock 36 for rotating the coupling shaft 10.

The coupling shaft 10 is rotated so that the observed point of maximum run-out of the coupling shaft 10 is nearest the ram member 42 of the press 29. The press 29 is activated and the ram member 42 engages the coupling shaft 10 at a point along a longitudinal line including the observed apex. The press 29 applies a force to the coupling shaft 10 to permanently deflect the same and thereby correct any observed radial misalignment.

The straightening apparatus 30 may obviously include additional indicators for measuring run-out at various other locations along the coupling shaft 10, and may include additionally measuring and pressing steps in response to additional run-out readings.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. A method of straightening a coupling shaft comprising a tubular member having a midship tube shaft affixed at one end thereof, the midship tube shaft being mounted in a center shaft support bearing assembly, comprising the steps of:

a) rotatably supporting the coupling shaft at the end of the coupling shaft opposite the midship tube shaft;

b) supporting the coupling shaft at the center shaft support bearing which rotatably supports the midship tube shaft of the coupling shaft;

c) rotating the coupling shaft about its longitudinal axis relative to a means for measuring radial misalignment thereof;

d) measuring the radial misalignment at a location along the midship tube shaft; and e) applying a force to the coupling shaft to permanently deflect the same to thereby reduce any observed radial misalignment.

2. A method as defined in claim 1, wherein the distal end of the midship tube shaft includes external splines, the method further comprising the step of fitting a substantially straight cylindrical reference sleeve over the end of the midship tube shaft prior to measuring radial misalignment.

3. A method as defined in claim 1, wherein the center shaft support bearing assembly includes an annular bearing mounted in an elastic support member held by a generally U-shaped bracket, the method further comprising the step of supporting the center shaft support bearing assembly at the open end of the bracket and applying a force to the bracket to compress the elastic support member so that the periphery of the elastic support member is coextensive with the ends of the bracket during the measuring step.

4. A method of straightening a coupling shaft comprising a tubular member having a midship tube shaft affixed at one end thereof, the distal end of the midship tube shaft being provided with external splines, and the midship tube shaft being rotatably mounted in a center shaft support bearing assembly including an annular bearing mounted in an elastic support member held by a generally U-shaped bracket, comprising the steps of:

a) rotatably supporting the coupling shaft at the end of the coupling shaft opposite the midship tube shaft;

b) supporting the coupling shaft at the open end of the bracket of the center shaft support bearing assembly;

c) applying a force to the bracket to compress the elastic support member so that the periphery of the elastic support member is coextensive with the ends of the bracket;

d) fitting a substantially smooth, straight sleeve over the end of the midship tube shaft;

e) rotating the coupling shaft about its longitudinal axis relative to a means for measuring radial misalignment thereof;

f) measuring the radial misalignment at a location along the midship tube shaft; and g) applying a force to the coupling shaft to permanently deflect the same to thereby reduce any observed radial misalignment.

* * * * *